US006647562B1

(12) United States Patent
Arout et al.

(10) Patent No.: US 6,647,562 B1
(45) Date of Patent: Nov. 18, 2003

(54) METHOD FOR MAKING PORTABLE, STRONG, LIGHT-WEIGHT AND EASILY ASSEMBLED CONTAINING STRUCTURES USING INTERLOCKING PANEL MEMBERS

(76) Inventors: John Arout, 96 Holcomb Ave, Staten Island, NY (US) 10312; Carmine Braccia, 5610 Amboy Rd., Staten Island, NY (US) 10309

( * ) Notice: Subject to any disclaimer, the term of this patent is extended or adjusted under 35 U.S.C. 154(b) by 78 days.

(21) Appl. No.: 10/246,119

(22) Filed: Sep. 19, 2002

Related U.S. Application Data

(63) Continuation-in-part of application No. 09/835,777, filed on Apr. 16, 2001, now abandoned.
(60) Provisional application No. 60/212,809, filed on Jun. 19, 2000.

(51) Int. Cl.[7] ..... E04H 4/00
(52) U.S. Cl. ..... 4/506; 4/584; 52/169.7
(58) Field of Search ..... 4/506, 584–587, 4/595; 52/169.7

(56) References Cited

U.S. PATENT DOCUMENTS 3,969,776 A * 7/1976 Gildea ..... 4/546
4,283,804 A * 8/1981 Mahoney ..... 4/506
5,743,283 A * 4/1998 Horvath ..... 4/496
6,295,771 B1 * 10/2001 Desjoyaux et al. ..... 52/169.7

* cited by examiner

*Primary Examiner*—Tuan N. Nguyen
(74) *Attorney, Agent, or Firm*—Stephen W. White

(57) ABSTRACT

A portable water-containing structure formed from a series of interlocking panel elements that can be interlocked easily without the use of tools. These panels may be used to form such water-containing structures as wading or swimming pools and may also be used to form an ice rink, spa, fish pond, flowerbox, window box and may other elements. The structures so formed are easy to assemble and disassemble, are strong and utile and can be formed in situ at any desired location.

4 Claims, 7 Drawing Sheets

METHOD FOR MAKING PORTABLE, STRONG, LIGHT-WEIGHT AND EASILY ASSEMBLED CONTAINING STRUCTURES USING INTERLOCKING PANEL MEMBERS

CROSS-REFERENCES TO RELATED APPLICATIONS

This application is related to our previously filed Provisional Application, U.S. Ser. No. 60/212,809, filed Jun. 19, 2000 and is a Continuation-in-Part of our patent application, U.S. Ser. No. 09/835,777, filed on Apr. 16, 2001 now abandoned, the sum and substance of which is incorporated herein by reference.

BACKGROUND OF THE INVENTION

1. Field of the Invention

This invention relates to the field of easily constructed, portable, containing structures such as those that can be used as swimming, wading, reflecting, skating rinks, spas or for the containment of flowers and the like. More specifically, this invention relates to water-containing elements that can be assembled and disassembled with ease and without the use of tools to provide a strict measure of portability and ease of use. Even more specifically, this invention relates to a strong, rigid and light-weight water-containing structure easily snapped, locked and/or slipped together using panel elements so as to provide long and useful life and used with a great deal of safety. Still more specifically this invention relates to an easily assembled water-containing structure that can be put together without the use of any tools and is easily disassembled for storage and the like.

2. Description of the Prior Art

There are a host of prior art references that describe structures that can be used as pools for both above and below ground applications. One such reference is U.S. Pat. No. 3,793,651 issued Feb. 26, 1974. This reference describes an above ground pool structure and the construction thereof. This and other references teach that the pools can be used on most level surfaces and comprise an endless vertical wall describing either a circular or oval-shaped area with a water-containing membrane (e.g. "liner") placed therein. The walls described are conventionally thin, flexible steel that is attached to a plethora of reinforcing elements along the outside surface thereof. In particular, these prior art pool structures are conventionally made by laying down a lower, reinforcing means into which the thin wall is inserted. Next, a series of upright reinforcing elements are attached to this thin wall using a multitude of bolts and nuts that must be applied using a set of tools and usually requires more than one person to install. This thin, reinforced wall then serves to hold the liner in place. Water is next added into the liner along with optional elements such as pumps, filters, skimmers, heaters, etc., as is well known in the prior art. The construction of this prior art pool structure is complicated and, as mentioned above, requires more than a single person to assemble and the use of tools and the like. Since there are such a host of parts and pieces, these structures are conventionally installed by contractors and pool installers who bring along extra parts such as additional nuts and bolts because many of these small parts get lost during the construction period.

The above described and so-called portable pool structures are designed to be used in the back yard or on a deck, etc. The problems involved with these prior art structures are myriad in number. First off, they are difficult to erect and require more than one person to be involved. There are a host of small elements such as nuts, bolts, washers, etc. involved in the construction and this also causes problems. Also, they are flimsy in nature and do not acquire rigidity except when filled with water. If a large gust of wind comes up during installation and prior to the addition of water, these pools tend to collapse since there is no water present to hold the shape of the pool and the pool structure is so light and flimsy. In addition, these particular pool elements require the use of a plurality of tools to be used during the construction phase. Additionally, these prior art pool structures are not designed to be disassembled. In fact, the disassembly of these structures is more difficult than the assembly since most of the metal parts tend to rust and freeze up. Many of these flimsy prior art pools can be used to form a round or oval-shaped pool. We do not know of any that are used to form a square, rectangle, hexagonal, etc. shaped element There are yet other prior art water-containing structures described. Some of these are constructed out of panel elements that can be connected in some fashion. Normally, these panel elements are interconnected using the same plethora of nuts and bolts as described above and thus require tools and more than one person to assemble. These particular prior art paneled water-containing structures normally have other elements used therewith. For example, British Patent Specification No. 876,480 dated Nov. 8, 1957 to Microcell, Ltd. describes a rectangular or square swimming pool structure made by bolting together a series of wall sections made from glass fiber or mineral glass, for example. These wall sections are secured one to the other and to a base element via flanges along the sides of the wall sections. The base section is said to be a wooden frame over which a canvas base is laid and the wall sections sandwich this base between the wall section and the wooden frame. Each wall section is attached to the others by the flange and a series of nuts and bolts are shown as the attaching means. A walkway and reinforcing structure surround this pool in order to provide suitable strength thereto, in fact it so required by this invention. The purpose of the Microcell pool as described is to furnish a swimming pool that does not need a liner. Water can be placed within the structure itself since, it is said, all connections of wall sections and the base are claimed to be water tight. There is no teaching of any disassembly of the pool formed within the metes and bounds of the Microcell reference. Once again, this prior art pool element requires the use of tools during construction.

Another prior art pool structure that uses panels and the light in the construction thereof is described by Desjoyaux et al., U.S. Pat. No. 6,295,771 B1, issued Oct. 2, 2001 based on WO99/02802, Jan 21, 1999. In this particular reference a series of panels are made by connecting an inner face with an outside face using a plethora of connecting elements comprising studs and narrowed slots. Each panel thus constructed must have an inner portion that can receive concrete poured therein so as to provide reinforcing. The panels thus formed are interconnected in a manner so as to form a water tight seal between each panel. This seal is formed by wings and slots designed to receive the wings and by tongues designed to slip into opposing holes and then expand to so as to form a permanent connection thereto. When all of this complicated structure is assembled and concrete poured into each panel, the sides of a swimming pool substantially rectangular is said to be produced. Once the panel is used to form the pool it is no longer a panel but forms the very essence of the pool structure. This reference appears to be silent as to any bottom section or the use of a liner to hold water. Additionally, this very complicated structure requires a host of installation equipment, tools and people and there is absolutely no disclosure to any disassembly thereof. In point of fact, the inventors state that it is their intent to prevent any inadvertent disassembly thereof by providing interconnecting means that cannot be disconnected. Tools are again required.

Most of the prior art pool structures are said to be rectangular or square. Round or oval structures are described either in the above flimsy pool elements referenced above or within permanent, cementitious pools and the like. None of the prior art structures are said to be truly portable in that none are said to be easily assembled or disassembled without destroying the pool itself. Thus, within the swimming pool art field there is a pressing need to provide a truly portable, simple, strong, light weight water-containing structure that can be manufactured easily into a plurality of shapes, one that can be easily assembled and easily disassembled for subsequent reuse and adaptability without the use of tools. There is also a pressing need for a water-containing structure that can be put together by a single person without the use of tools and the like. Finally, there is also a need for structures that can be constructed in round, oval, rectangular, square T- and L-shapes, etc. at a reasonable cost and with true portability made to be easily assembled or disassembled without the use of tools.

SUMMARY OF THE INVENTION

These and yet other objects and needs are achieved in a method for making a portable, easily assembled and easily disassembled containing structure wherein said method includes connecting a series of interlocking panel elements, said panel elements having a horizontal top, a horizontal bottom, an outside wall and a containing wall, and two vertical interconnecting edges, one of each of said edges comprising a series of female interconnecting elements and the second of said edges comprising a series of male interconnecting elements, whereby when said interlocking panel elements are interconnected by inserting said male interconnecting edge on one panel into an opposing female interconnecting edge on another panel, and when sufficient of said panels are interconnected so as to form a shape, a containing structure is defined. In yet another embodiment the containing structure of this invention will be a water-containing structure useful as, for example, a swimming pool.

DETAILS OF THE INVENTION

Figure 1:
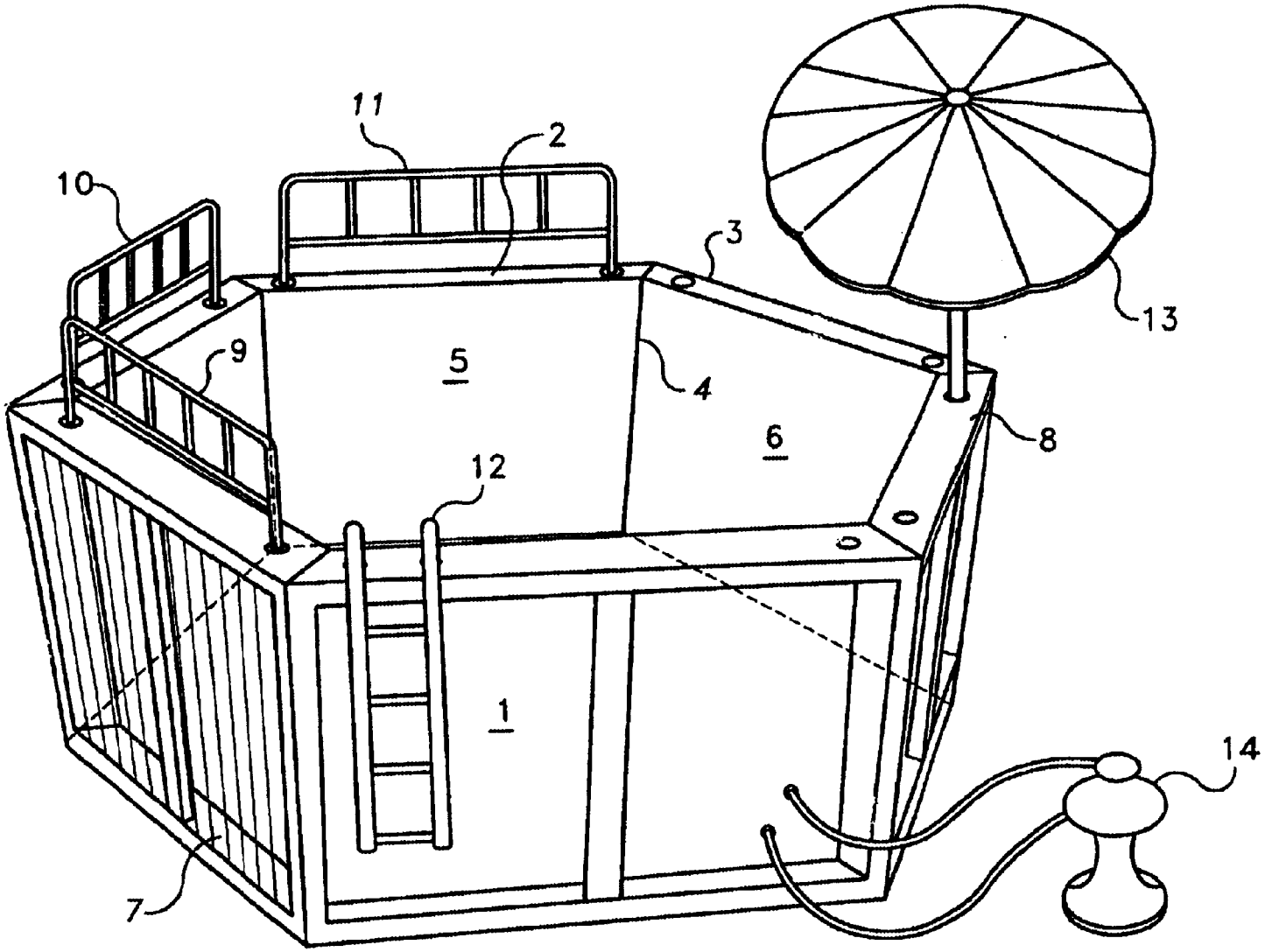
FIG. 1 is a view of a complete hexagonal swimming pool structure made by interconnecting a series of panels using the novel panel elements of this invention.

Looking now specifically at the drawings that show some, but not all, of the embodiments of this invention, FIG. 1 is a view of a complete swimming pool structure made by interconnecting a series of panels using the novel panel elements and connecting means described in detailed later on. In this particular showing, the pool is hexagonal in shape, although this invention is not limited to any particular shape that can be made from these elements. In this Figure, the area contained by the panel elements and which forms a pool in this view is shown as 1. Two panel elements out of 6 are shown as 2 and 3 and are joined along the line represented by 4 the interior water-containing walls of these panel elements are shown as 5 and 6. The connecting devices that make the joining of panel elements together are not shown in this drawing. The front of each panel is shown trimmed out with wood and one of these fronts is shown as 7. In this figure tube elements may be contained in each panel and one of these is shown as 8. Three railing elements may be installed within the tube elements and these are shown as 9, 10, and 11. A ladder 12 is shown installed in two other tube elements and an umbrella 13 in yet another. A typical pump system is shown as 14. All of these accessories can also be installed without the use of tools and the like. When a pool liner is added within area 1 a swimming pool will be formed.

Figure 2:
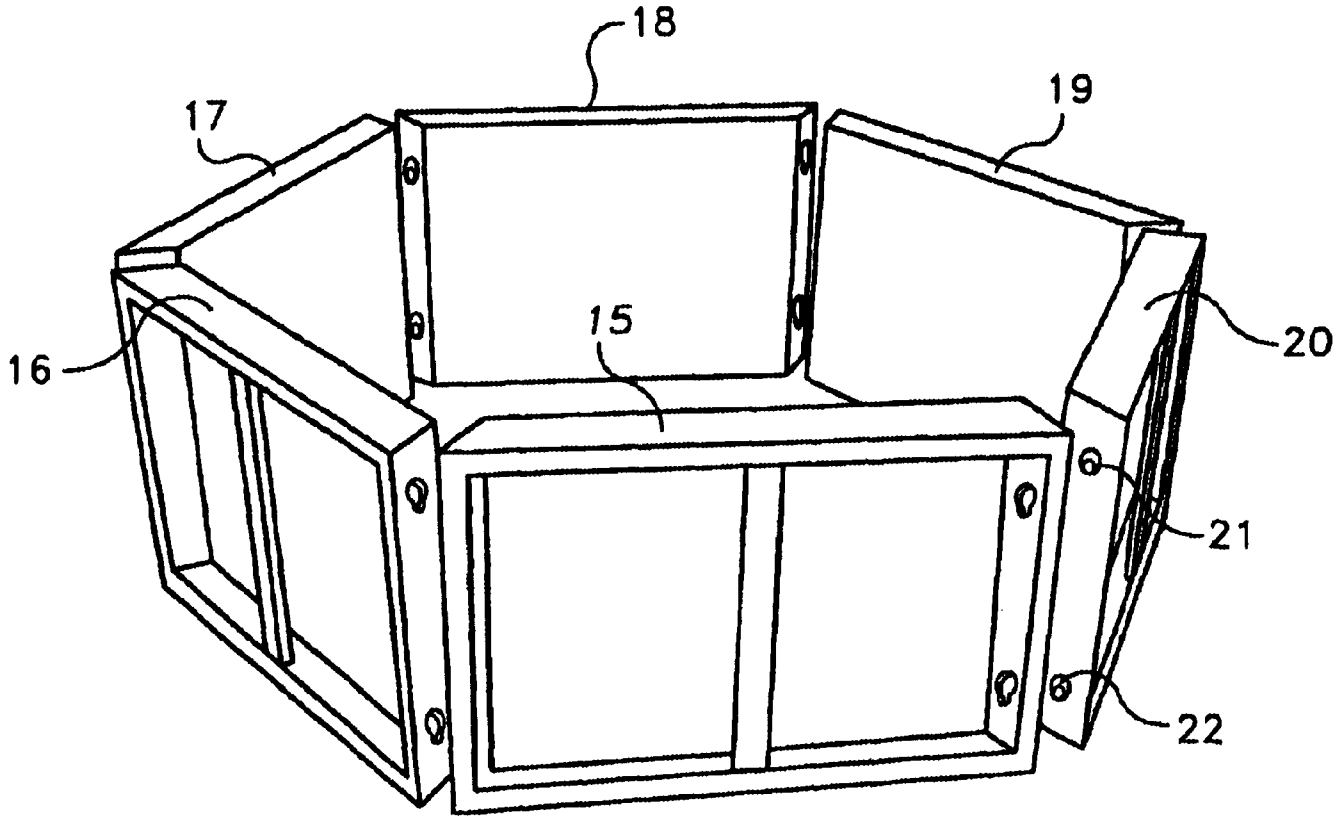
FIG. 2 is a drawing showing panel elements similar to those of FIG. 1 being assembled into a hexagonal shape.

A set of six (6) panel elements (15–20) ready to be assembled into a hexagonal shape are shown in FIG. 2. Fixed key connecting elements 21 and 22 can be seen on a vertical side of panel 20. These connecting elements are ready to be installed (not seen in this view). Thus, one vertical end of each panel will contain a male connecting fixed key and the other will contain a female connecting keyhole. Each panel is easily assembled one to the other to form the shaped containing structure shown in FIG. 1. After a pool liner is added, the containing structure becomes a pool. Each panel can be easily disassembled one from the other for either transportation, storage or for any other reason.

Figure 3:
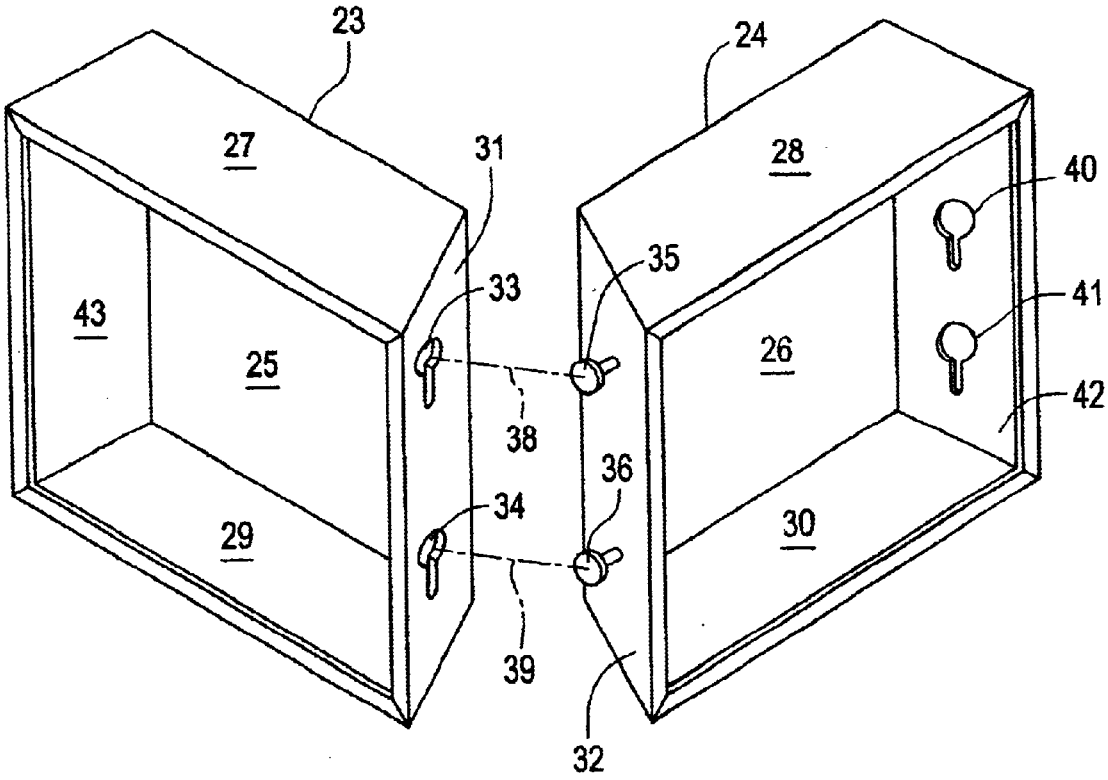
FIG. 3 is a drawing of a pair of panel elements showing the details of one side of the connecting elements wherein said connecting elements being fixed key and keyhole elements.

In FIG. 3, a pair of panel elements 23 and 24 are shown ready for connection with some details around the connecting elements. In this figure, the interior water-containing walls are shown as 25 and 26, the top rails as 27 and 28 and the bottom rails as 29 and 30. Vertical edge 31 of panel 23 is shown with a pair of female connecting elements further as keyholes 33 and 34. Vertical edge 32 of panel 24 is shown with a pair of male connecting elements further as fixed keys 35 and 36. The two panel elements are thus interconnected by inserting the male fixed keys 33 and 34 into the female keyholes 34 and 35 along the dashed lines 38 and 39 and dropping the fixed key into the narrow portion of the keyhole. A simple reversal of this step disconnects the two panels with no tools required. Another pair of female keyholes (40 and 41) can be seen on vertical end 42 of panel 24. A pair of male fixed keys (not seen herein) will be contained on vertical edge 43 of panel 23.

Figure 4:
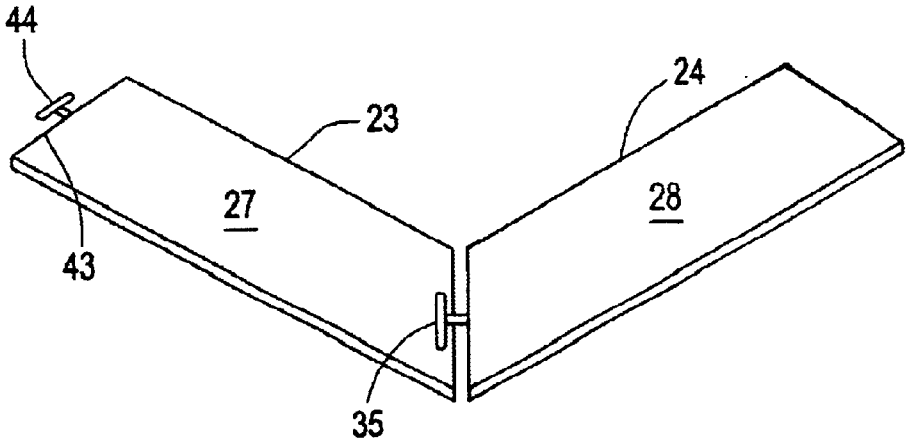
FIG. 4 is a drawing of the pair of panel elements from FIG. 3 connected.

In FIG. 4, the pair of panel elements 23 and 24 from FIG. 3 is shown connected by the fixed key 35 that has been inserted through the opposing keyhole 33 and then dropped down into the narrow end of this keyhole to form a secure connection thereto. A fixed key 44 on the opposite vertical edge 43 of panel 23 can also be seen in this view.

Figure 5:
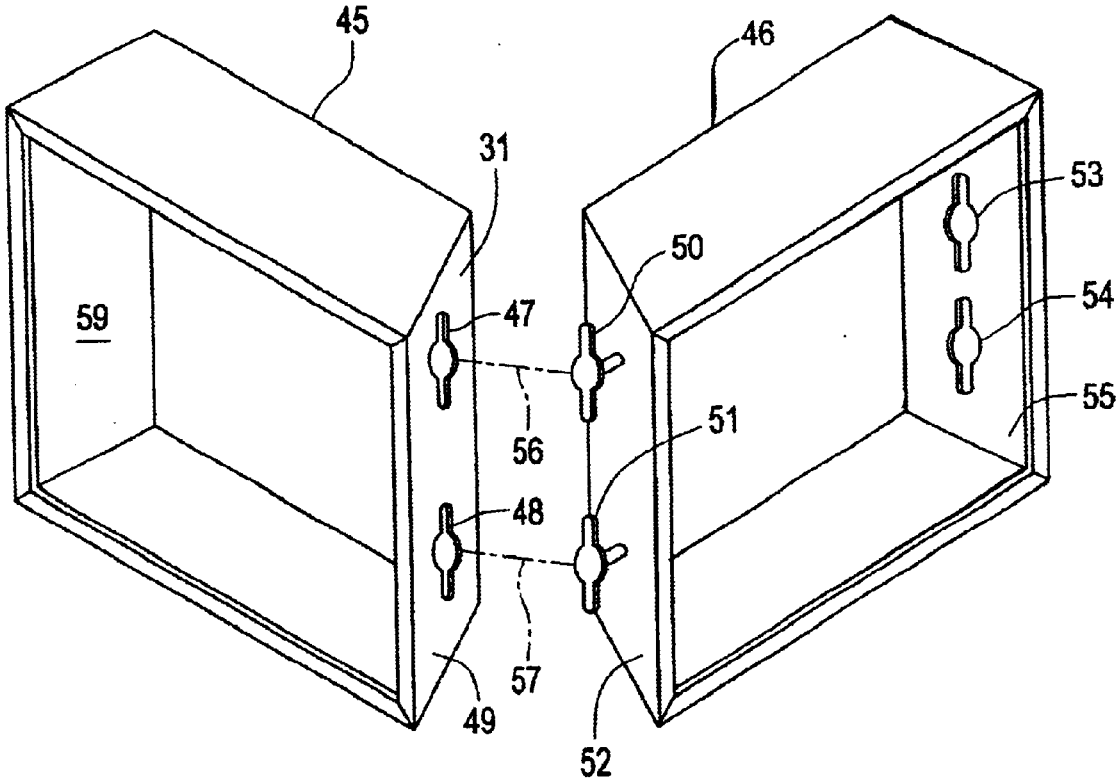
FIG. 5 is a drawing of a pair of panel elements showing the details of one side of the connecting elements wherein said connecting elements are cam lock elements.
Figure 6:
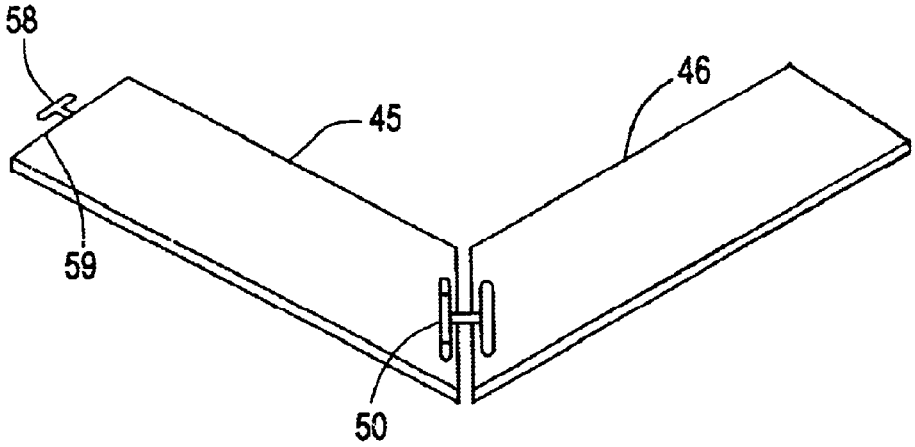
FIG. 6 is a drawing of the pair of panel elements from FIG. 5 connected.

In FIG. 5 another pair of panel elements 45 and 46 are shown with yet another embodiment of connecting elements used to easily connect and disconnect said panels. In this showing a pair of female cam locking holes are shown as 47 and 48 on vertical edge 49 of panel 45. An opposing pair of male cam locking elements 50 and 51 are shown on the vertical edge 52 of panel 46. Another pair of female cam lock holes 53 and 54 are shown on vertical edge 55 of panel 46. When male cam locking elements 50 and 51 are inserted into opposing female cam locking holes 47 and 48 along dashed lines 56 and 57 and then turned to lock into place, panels 45 and 46 will be firmly locked together as shown in FIG. 6. In FIG. 6, a male cam locking element 58 can be seen on opposing vertical edge 59 of panel 45. A simple reversal of these steps will serve to disconnect these two panels easily and quickly with no tools require.

Figure 7:
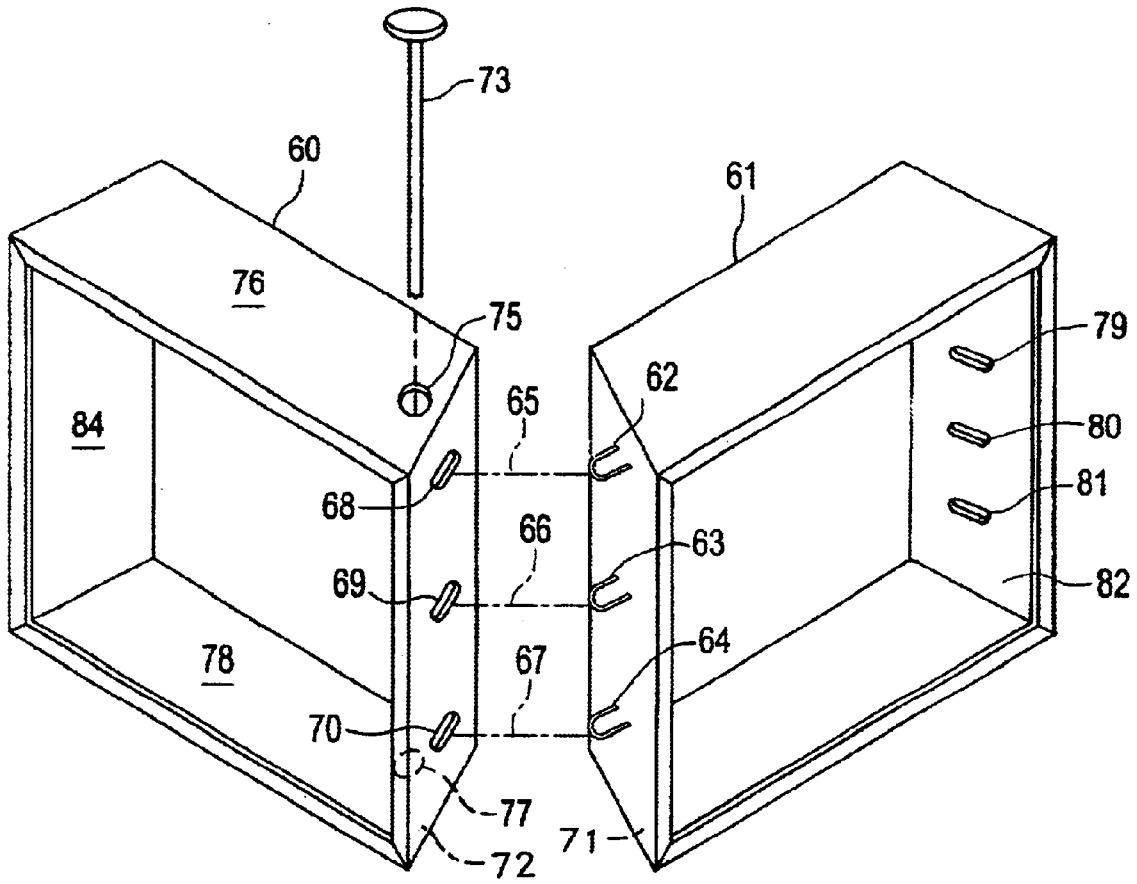
FIG. 7 is a drawing of a pair of panel elements showing the details of one side of the connecting elements wherein said connecting elements are a pin insertable into a series of hooks inside slots.
Figure 8:
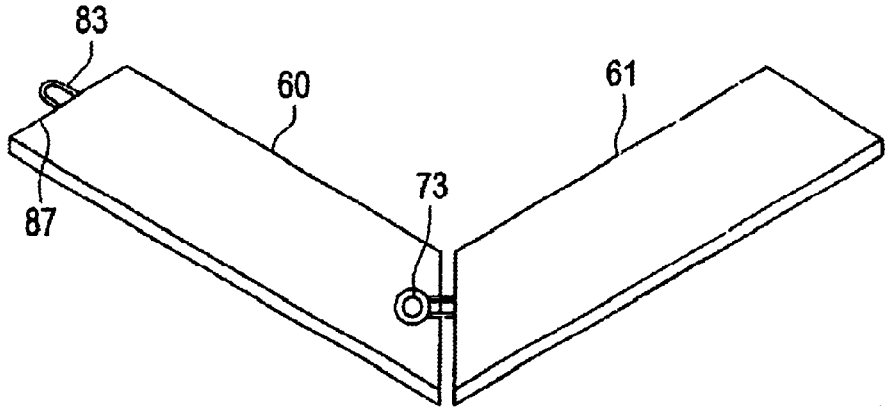
FIG. 8 is a drawing of the pair of panel elements from FIG. 7 connected.

Still another means for connecting and disconnecting a pair of panel elements shown as 60 and 61 is demonstrated in FIG. 7. In this showing a set of three (3) male hooks 62–64 along vertical edge 71 of panel 61 are inserted into three (3) slots 65–67 located in vertical edge 72 of panel 60 following along dashed lines 68–70. A pin 73 is then inserted through a hole 75 located in top rail 76 of panel 60 and down through the male hooks and into another hole 77 located in the bottom rail 78 of panel 60. Another set of three slots (79–81) is located along vertical edge 82 of panel 61. The connection of these two panels is seen in FIG. 8 with another male hook shown as 83 on vertical edge 84 of panel 60.

Figure 9:
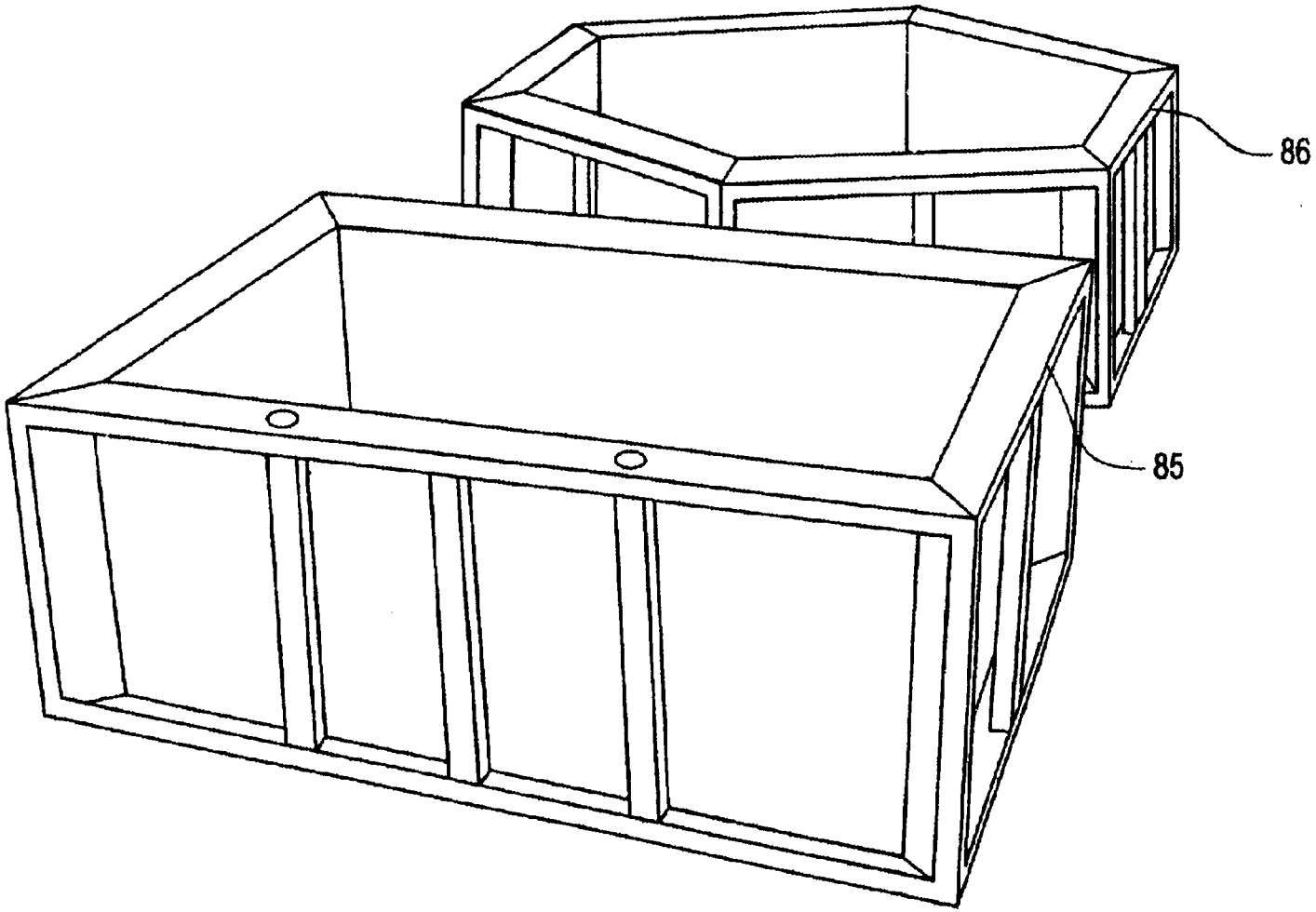
FIG. 9 is a drawing of a square pool and the octagonal pool from FIGS. 1 and 2 made according to the teachings of this invention.

In FIG. 9 another configuration (square) of a water containing element can be seen. Here, square element 85 is shown next to hexagonal element 86 resulting from the connection of the panel elements detailed in FIG. 2.

Figure 10:
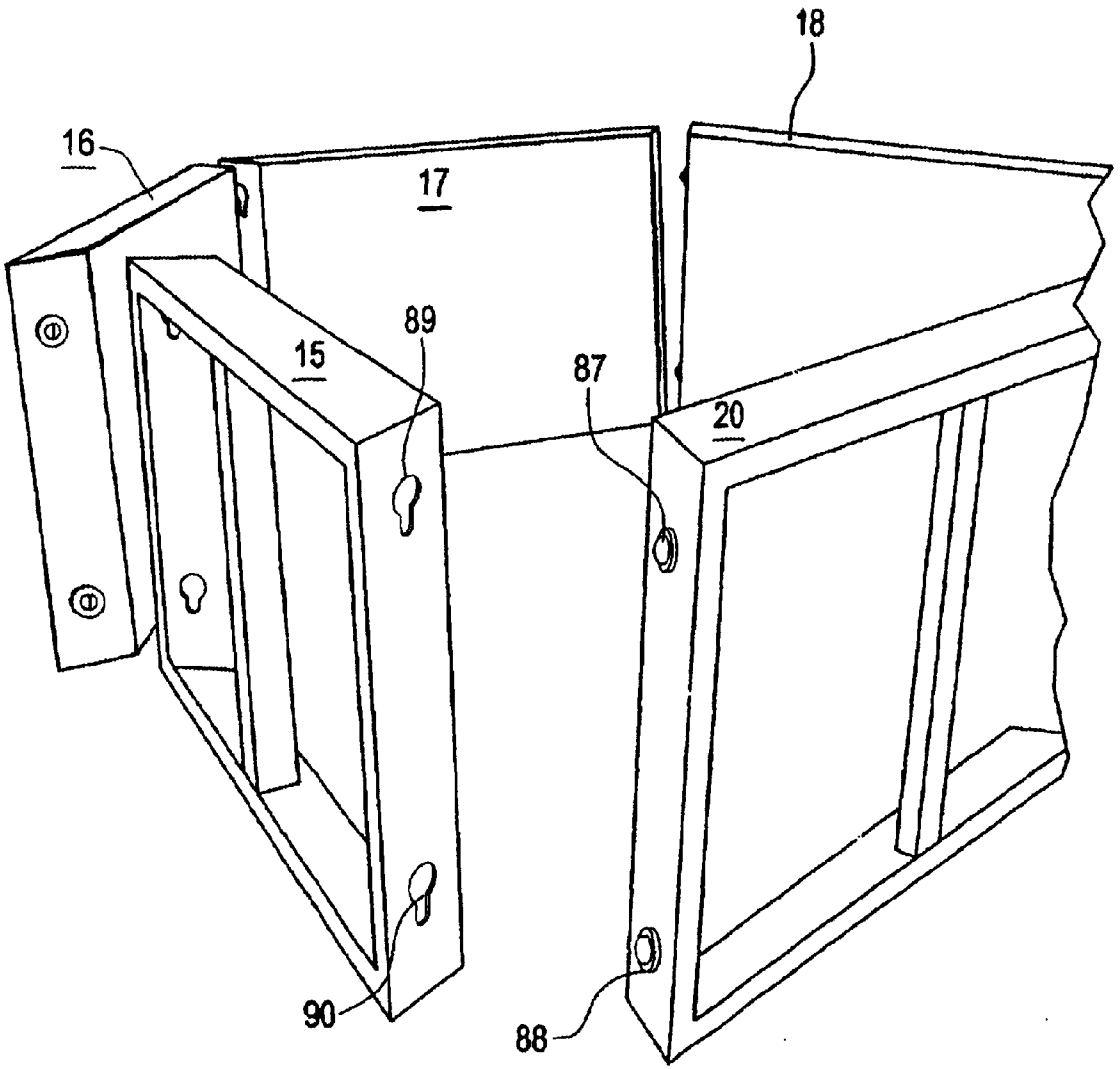
FIG. 10 is a detailed showing of the fixed key and keyhole elements joining the pool panels previously described.

In FIG. 10 some additional details of the fixed key (male) and keyhole (female) preferred connection device is shown. The panel elements from FIG. 2 are again shown with details of the fixed key and keyhole connection device between panel 15 and 20 shown. The two fixed male key elements are shown as 87 and 88 while the two female keyhole elements are shown as 89 and 90. It can be seen from this figure that it is relatively easy to simply insert both fixed key elements into the large end of the opposing keyholes and then make a firm attachment by dropping the keys down into the smaller end of said keyholes.

Pools and other water-containing structures that can be fashioned from and according to the teachings of this invention may assume a myriad of shapes including T- and L-shapes; triangular; octagonal; pentagonal; square; rectangular; etc. One only needs to use the proper interlocking panels to fit the desired shape, for example. The panels can be manufactured from a plethora of materials including steel, aluminum or other thin metals and plastics, for example. We prefer a panel made from 20 to 12 gauge aluminum with a preferable thickness of between 18 to 16 gauge. These interlocking panels may be made in any length and height desired. A particularly useful dimension is about 10 feet in length and about 5 feet in height since these elements can be easily obtained and handled. However, longer panels are envisioned for longer length structures. Starting with higher panels or simply joining panels along the length thereof can achieve increases in height.

Interlocking panels made for the structure of this invention may be interlocked using the interlocking means described above and shown in the drawings. Although it may be interpreted that such interlocking means are known in the prior art none have heretofore been used to provide containing structures as described herein. Interlocking means other than those actually described herein may be used as well. The only requirement is that they be easily connected and disconnected without the use of any tools. The fact that such interlocking means could provide a quick and simple means to join a multitude of panels that could for a strong and useful containing structure is new. Each panel will contain male interlocking elements on one vertical side and female interlocking elements on the opposite vertical side. When it is desired to make an angle between two panels (e.g. right angle in the case of square, rectangle T- or L-shapes) the vertical opposing edges of each panel should be right angles also in order to line up. Alternatively, one may have angled opposing edges in order to form other forms described. The fixed key and keyhole connecting elements are preferred but any of the means described above may be used just as well.

Decorative siding may be added to enhance the beauty and utility of the containings structure of this invention. In FIG. 1 a water-containing pool structure is shown with decorative siding installed along the outside walls of each panel. Any conventional material may be used to provide such a decorative cover or siding. In this particular case, the decorative siding used was so-called Texture 1-11 that has been installed between the top and bottom edges. This may be accomplished by sliding pieces of the siding in a groove provided or by screws along each edge. This material may then be stained to match a deck, for example. However, any conventional material may be used just as well. These materials include aluminum siding; cedar siding; stucco; brick; mortar; or any of the conventional materials used to side buildings and the like. These may match the decor of the surroundings in which the containing structure of this invention is placed. Decorative siding can be added at any stage of the manufacture of the panels of this invention. Alternatively, decorative panel covers may be provided as so-called "slide-in" elements. This particular feature would allow a decorative change to be accomplished as well as to permit the user to remove the slide-in decorations in order to access the connection elements contained within the panels.

After several panels have been interlocked to form the desired containing structure, any other use is up to the user. For example, a pool liner may be installed in a conventional manner and a top rail applied over this liner to hold it in place. Alternatively, snap-in grooves can be provided right in the top rail of each panel by the manufacturer so as to permit the liner to be snapped in place. Other conventional means for holding a liner within a water-containing structure may also be employed within the metes and bounds of this invention. Then, this may be filled with water to form a delightful wading or swimming pool Various pumps, filters, skimmers and the like may be added to help maintain the pool in a conventional manner. Some of these additions are shown in FIG. 1.

As previously mentioned, pools, such as swimming and wading pools, can be made very easily using the panel elements of this invention. It is a simple task to join together a plurality of interlocking panel elements in the shape desired, pop in a pool liner and fill the pool with water. All of this can be accomplished by a single person without the use of any tools or other devices. Pools thus made can also be used as garden reflecting pools, fish ponds, etc. One great improvement in addition to the sturdiness and ease of construction is that these pools can be drained of water during the off-season (or for any other desired purpose or time of year) and either taken down and stored or simply left up. Prior art pools and water-containing structures are extremely difficult to disassemble and in point of fact most either cannot be so disassembled. In most cases, nuts, bolts, screws and other elements used to put up prior art elements become rusted and cannot be removed without damaging the surrounding structure. Most of the pools described in the prior art above are made for permanent installation. Thus, these pools have the water left inside during the off season in order to prevent collapse of the pool walls.

The elements of this invention may also be joined to form a skating rink. For example, a skating rink made about 4–6 inches in height would be safer to use and would provide a more propitious skating area. As previously mentioned, size is not a problem since the interlocking panel elements can be manufactured in any given length and width or, alternatively, joined together top and bottom to increase width. Some changes in the connecting edges are necessary if the angle of connection is changed from a right to some other angle but this is a manufacturing detail. It is only necessary that the connecting edges be parallel to each other when the connection is made. When a plurality of interlocking panels are connected in this manner, a water-containing structure such as a pool, skating rink, flower box, etc. is defined.

In addition to the conventional pool elements (e.g. filters, pumps and the like) it is possible to add exterior elements such as an umbrella or a canopy to the water-containing structures of this invention. This can easily be accomplished by providing tube elements within the interlocking panel elements at convenient points so that umbrella or canopy handles can be inserted therein. This lends considerable utility to the water-containing structure of this invention since this is difficult with most prior art elements. In addition, cup holders, etc. can be placed along the top rail of the pool quite easily and conveniently. Other decorative elements can be added to the sides in order to insure that the water-containing structure of this invention has unique characteristics. All accessories can be installed without the use of any tools.

Still another use for the water-containing structure of this invention is as a spa element. For example, heaters, bubblers and the like may be added to turn the structure of this invention into a hot tub or spa element. In that case, it may be useful to add insulation to the interlocking panels in order to conserve the heat. This is quite easy to do as the panels shown within the figures of this invention have an area into which such insulation can be easily placed. Also, an insulated top may be constructed and added to prevent heat from escaping from the water surface when not in use. Since such an element can be easily assembled it can be used very well inside a building. It can be used within a nursing home or other facility where such a spa is very useful. If not needed, it can be easily taken down for storage. The structure of this invention may also be used as an immersion-type baptismal font. Some religious organizations require that baptism be accompanied by total immersion. Since this is often not possible at the church site, it is sometimes required that this service be removed outside to a suitable pool, pond, lake or river. By having such a removable structure as is defined by this invention, a pool can be kept inside the church itself for just such an event. After use, the pool can be taken down and stored.

It should be pointed out here that water-containing structures made according to the teachings of this invention are eminently useful, strong and rigid. For example, a user may sit on the top rail of a water-containing structure made as taught herein without having the walls collapse. This is not possible with most of the prior art back-yard pool elements described above. In addition, steps or seating areas may be included within the pool itself. This may be accomplished by manufacturing the panel elements with the various steps or seats already attached thereto. These last elements may be made from the same materials of construction as used to make the panel elements and they may be integrally attached within the pool using the same interconnection elements previously described. Once again, no tools will be required. This is another distinct advantage over conventional back-yard pool elements that do not have such inside steps and seats.

In yet another embodiment of this invention, posts may be placed within the slots as previously described for containing umbrellas and the like. By joining fence elements between these posts the safety of the water-containing structure of this invention is enhanced. FIG. 1 shows these fence elements. This integral safety feature is lacking in most prior art elements. Finally, a sand box may be made from smaller panel elements made according to the teachings of this invention. Thus, the utility of our structure can be employed within a wide area including swimming and wading pools, fish tanks, spas, flower boxes and sand boxes all of which can be put together without the use of tools.

To demonstrate the utility of our invention a series of panel element was constructed so as to form a square swimming or wading pool. The pool was assembled using interlocking panels described herein to connect the panels at right angles. This then defined a water-containing structure with an 8' by 8' square being 2' deep. A liner was placed therein and a top rail placed over the top edge of the panel elements in order to hold the liner in position. The pool was ready to fill within 20 minutes and was made by one man without the use of any tools whatsoever. No other conventional pool can be made in this fashion, especially in a square shape. The pool was inserted within the deck surround the pool to form a delightful swimming and cooling off pool. The construction was easy, required no tools and was completed quickly. Disassembly of this pool would be just as easy, once the water was drained therefrom.

What is claimed is:

1. A method for making a portable, lightweight, easily assembled and easily disassembled water-containing structure wherein said method includes connecting a series of interlocking panel elements, said panel elements having a horizontal top, a horizontal bottom, an outside wall and a containing wall, and two vertical interconnecting edges, one of each of said edges comprising a series of female interconnecting elements and the second of said edges comprising a series of male interconnecting elements, whereby when said interlocking panel elements are interconnected by inserting said male interconnecting edge on one panel into an opposing female interconnecting edge on another panel, and when sufficient of said panels are interconnected so as to form a shape, a liner is added to define said water-containing structure and whereby when said male interconnecting elements are subsequently disassembled from said female connecting elements no damage is caused thereto and said panels are usable for re-forming said water-containing structure.

2. The method of claim 1 wherein said female and male interconnecting elements comprise fixed male keys and female keyholes, male cam locks and female cam holes, male hooks, female slots and pins.

3. The method of claim 1 wherein said water-containing structure is a swimming pool.

4. The method of claim 1 wherein vertical tube elements are provided in the horizontal top of said interlocking panels and accessories are added to said vertical tube elements.

* * * * *